US006033819A

United States Patent [19]

Matsui et al.

[11] Patent Number: 6,033,819

[45] Date of Patent: Mar. 7, 2000

[54] MICROCAPSULE TONER HAVING A MICROPHASE SEPARATION STRUCTURE

[75] Inventors: Izuru Matsui; Kazufumi Tomita, both of Minami Ashigara, Japan

[73] Assignee: Fuji Xerox Co., Ltd., Tokyo, Japan

[21] Appl. No.: 08/082,727

[22] Filed: Jun. 28, 1993

[30] Foreign Application Priority Data

Jun. 29, 1992 [JP] Japan ..... 4-192725

[51] Int. Cl.[7] ..... G03G 9/093

[52] U.S. Cl. ..... 430/109; 430/111; 428/402.21; 428/428.22

[58] Field of Search ..... 430/109, 111, 430/138; 428/402.21, 402.22

[56] References Cited

U.S. PATENT DOCUMENTS

| | | | |
|---|---|---|---|
| 3,876,610 | 4/1975 | Timmerman et al. | 430/109 |
| 3,893,932 | 7/1975 | Azar et al. | 430/109 |
| 3,974,078 | 8/1976 | Crystal | 430/109 |
| 4,016,099 | 4/1977 | Wellman et al. | 430/109 |
| 4,254,201 | 3/1981 | Sawai et al. | 430/109 |

FOREIGN PATENT DOCUMENTS

| | | |
|---|---|---|
| 51-124435 | 10/1976 | Japan . |
| 55-18654 | 2/1980 | Japan . |
| 56-119137 | 9/1981 | Japan . |
| 57-179860 | 11/1982 | Japan . |
| 58-66948 | 4/1983 | Japan . |
| 58-45964 | 8/1983 | Japan . |
| 59-148066 | 8/1984 | Japan . |
| 59-159174 | 9/1984 | Japan . |
| 59-162562 | 9/1984 | Japan . |
| 60-83958 | 5/1985 | Japan . |

*Primary Examiner*—Bernard Codd
*Attorney, Agent, or Firm*—Oliff & Berridge, PLC

[57] ABSTRACT

A microcapsule toner comprising an outer shell and a core containing a fixable component, wherein the fixable component has a micro phase separation structure composed of a liquid continuous phase and a disperse phase containing a resin and having a glass transition temperature of not higher than 20° C., and said fixable component contains a block and/or graft copolymer comprising two or more monomer components, at least one of the monomer components being compatible with said disperse phase with the other monomer component or components being compatible with said continuous phase. On pressure application, the toner is instantaneously fixed to provide a fixed toner image which does not fall off or is not destroyed by outer force. The fixable component forms a stable micro phase separation structure which satisfies both fluidity before fixing and hardness after fixing and retains fixability during long-term preservation.

7 Claims, No Drawings

MICROCAPSULE TONER HAVING A MICROPHASE SEPARATION STRUCTURE

FIELD OF THE INVENTION

This invention relates to a microcapsule toner which is used for visualization of an electrostatic or magnetic latent image to form a toner image in electrophotography, electrostatic recording or magnetic recording.

BACKGROUND OF THE INVENTION

A toner image formed on an electrostatic or magnetic latent image is generally transferred to paper or a like medium and fixed thereon by heat fixing, solvent fixing, pressure fixing, etc. Pressure fixing, in which a toner image is fixed by application of pressure only, is advantageous in that an electric power consumption is small, a rapid start in fixing can be made, a high-speed fixing system can be applied, and the apparatus is simple.

On the other hand, however, fixing properties attained by pressure fixing is insufficient. That is, the pressure-fixed toner particles are apt to fall off the medium. An increase in applied pressure in an attempt to obtain a sufficient fixing level is attended by disadvantages such that transfer paper is damaged or becomes semi-transparent, the toner image becomes shiny, and the size of the fixing apparatus must be increased accordingly. The fixing level obtained for these disadvantages is still insufficient. In addition, a pressure-fixable toner contains a resin ready to be deformed on pressure application. This resin component tends to contaminate a photoreceptor or carrier particles used in a two-component developer or tends to deteriorate fluidity of the toner.

In order to solve these problems, capsule toners comprising microcapsules containing a pressure-fixable material, etc. have been developed. Since a pressure-fixable material is enclosed in capsule wall, it causes no contamination of a photoreceptor or carrier particles or no adverse influences on toner fluidity. Nevertheless, even capsule toners do not always achieve sufficient fixing performance properties depending on the characteristics of the pressure-fixable material to be used as a core material.

For example, where a wax as disclosed in JP-A-55-18654 (the term "JP-A" as used herein means an "unexamined published Japanese patent application") or a liquid polymer as disclosed in JP-A-59-162562 is used as a pressure-fixable material, fixing properties achieved are not sufficient. While these pressure-fixable materials exhibit fixability, the fixed toner comes off by outer force with comparative ease, for example, when rubbed with fingers or when paper is superposed on the fixed toner image and letters are written thereon with a ballpoint pen. This is because the fixable component which is deformed or fluidized by pressure, such as a wax and a liquid polymer, retains its character of being deformed or fluidized even after being fixed.

A pressure-fixable material comprising a high-boiling solvent and a polymer as proposed in JP-A-58-145964 provides an excellent fixing level because the high-boiling solvent penetrates into paper or volatilizes after fixing to harden the pressure-fixable material. However, it takes time for the high-boiling solvent to penetrate into paper or to volatilize so that sufficient fixing strength cannot be obtained immediately after fixing.

For the purpose of obtaining a high fixing level or rapid fixing properties, JP-A-60-83958 discloses a pressure-fixable material having a disperse system in which a high-boiling solvent having dissolved therein a polymer forms a disperse phase and an organic liquid which is incapable of dissolving the polymer and incompatible with the high-boiling solvent forms a continuous phase. However, according to the structure disclosed, a stable disperse system cannot be formed. That is, the fixable material is separated into a polymer-containing high-boiling solvent phase and an organic liquid phase within the capsules during preservation, failing to maintain satisfactory fixability. Besides, since a solution of a polymer in a high-boiling solvent is used as a disperse phase, a sufficient fixing level cannot be reached until the high-boiling solvent volatilizes or penetrates into paper, i.e., instantaneous fixing cannot be achieved.

Although it is possible to reduce the time for reaching sufficient fixing strength by increasing volatility of a solvent in which a polymer is dissolved or dispersed, a system involving volatilization of a solvent, whether highly volatile or not, entails environmental pollution.

A core material comprising an organic solvent, a high polymer soluble in the organic solvent, and a pressure-fixable substance insoluble in the organic solvent is disclosed in JP-A-56-119137. According to this structure, a stable disperse system cannot be formed similarly to the above-mentioned technique, and the pressure-fixable substance undergoes sedimentation or agglomeration in the capsules during preservation. In addition, a sufficient fixing level cannot be reached because of the use of a wax type material as a pressure-fixable substance.

A core material comprising a non-aqueous solution or dispersion of a soft solid is disclosed in JP-A-51-124435. Even in the case of the non-aqueous dispersion, a stable toner film cannot be formed, and a sufficient fixing strength cannot be obtained instantaneously.

JP-A-59-159174 proposes a core material comprising two or more polymers having different glass transition temperatures. It is assumed from the method of preparation described, while not accounted for, that the two polymers are finely dispersed in the core, but the disperse state cannot be maintained in a stable manner.

SUMMARY OF THE INVENTION

An object of the present invention is to provide a microcapsule toner which are sufficiently and instantaneously fixed on pressure application to form a toner image that does not fall off or is not destroyed by outer force and which attains sufficient fixing strength without involving volatilization of a solvent component.

Another object of the present invention is to provide a microcapsule toner which retains fixing properties even when preserved for an extended period of time.

A pressure-fixable component must be deformed or fluidized on pressure application and, at the same time, must be hardened at the moment of fixing and assure sufficient fixing strength. Paying attention to these requirements, the present inventors have conducted extensive investigations and found as a result that fluidity before fixing and hardness after fixing can be obtained in good consistency by using a fixable component having a micro phase separation structure in which a liquid constitutes a continuous phase and by using a copolymer comprising at least two monomer components, one of which being compatible with the disperse phase with the other being compatible with the continuous phase, as a compatibilizer for forming a stable micro phase separation structure.

The present invention relates to a microcapsule toner comprising an outer shell and a core containing a fixable component, wherein the fixable component has a micro phase separation structure composed of a liquid continuous phase and a disperse phase containing a resin and having a glass transition temperature (Tg) of not higher than 20° C., and said fixable component contains a block and/or graft copolymer comprising two or more monomer components, at least one of the monomer components being compatible with the disperse phase with the other monomer component or components being compatible with the continuous phase.

According to the above-mentioned structure, the disperse phase undergoes phase inversion on fixing to form a film or, in some cases, the disperse phase agglomerates thereby to accomplish the above objects of the present invention.

DETAILED DESCRIPTION OF THE INVENTION

The terminology "micro phase separation structure" as used herein means a structure in which two phases essentially incompatible with each other are finely dispersed to several microns by the action of a compatibilizer, etc.

The microcapsule toner of the present invention is composed of a colorant and microcapsules made of a core containing a fixable component and an outer shell covering the core. The fixable component has a micro phase separation structure composed of a disperse phase and a liquid continuous phase and contains at least one of a block copolymer and a graft copolymer both comprising two or more monomer components, one of the monomer components being compatible with the disperse phase, and the other being compatible with the continuous phase. The colorant may be present either inside or outside the microcapsules. In the former case, the colorant may be present in either the core or the shell.

The resin which is present in the disperse phase includes styrene polymers, styrene-butadiene copolymers, epoxy resins, polyester, rubbers, polyvinylpyrrolidone, polyamide, coumarone-indene copolymers, methyl vinyl ether-maleic anhydride copolymers, amino resins, polyurethane, polyurea, (meth)acrylic ester polymers or copolymers, (meth)acrylic acid-(meth)acrylic ester copolymers, polyvinyl acetate, polyvinyl chloride, and mixtures thereof. Preferred of them are styrene polymers and (meth)acrylic ester polymers or copolymers. These resins may be used either individually or in combination thereof.

These resins can be used in an amount of from 50 to 100%, preferably from 70 to 100%, and more preferably from 85 to 100%, by the weight to the total disperse phase.

These resins preferably have a weight average molecular weight of from 20,000 to 200,000, and more preferably from 50,000 to 150,000.

The component constituting the disperse phase which forms a film through phase inversion or agglomeration on fixing is expected to adhere firmly to a transfer medium, such as paper, to exhibit excellent fixing properties. To this effect, a copolymer resin comprising a polymerizable tertiary amino-containing compound is preferably used as a resin in the disperse phase. The polymerizable tertiary amino-containing compound include those easily copolymerizable with styrene type or acrylic type radical polymerizable monomers. Specific examples of such tertiary amino-containing compounds are m-N,N-dimethylaminostyrene, p-N,N-dimethylaminostyrene, p-N,N-diethylaminostyrene, p-N,N-dipropylaminostyrene, p-N,N-dibutylaminostyrene, N-vinyldimethylamine, N-vinyldiethylamine, N-vinyl-N-butylethylamine, N-vinyldibutylamine, N-vinyl-N-ethylmethylamine, N-vinyldiphenylamine, N,N-dimethylisopropenylamine, N,N-diethylisopropenylamine, N-ethyl-N-methylisopropenylamine, N,N-dipropylisopropenylamine, N,N-diphenylisopropenylamine, N,N-dimethyl-1-propenylamine, N,N-diethyl-1-propenylamine, N,N-dipropyl-1-propenylamine, N,N-diphenyl-1-propenylamine, N,N-dimethylallylamine, N,N-diethylallylamine, dimethylaminoethyl methacrylate, diethylaminoethyl methacrylate, dimethylaminoethyl acrylate, diethylaminoethyl acrylate, dimethylaminopropyl methacrylate, diethylaminopropyl methacrylate, dimethylaminopropyl acrylate, diethylaminopropyl acrylate, 2-dimethylamino-2-methylpropyl methacrylate, 2-dimethylamino-2-ethylbutyl methacrylate, 2-dimethylamino-2-propylhexyl methacrylate, 2-diethylamino-2-methylpropyl methacrylate, 2-diethylamino- 2-ethylbutyl methacrylate, 2-diethylamino-2-propylhexyl methacrylate, p-N,N-dimethylaminophenyl acrylate, p-N,N-diethylaminophenyl acrylate, p-N,N-dipropylaminophenyl acrylate, p-N,N-dibutylaminophenyl acrylate, p-N,N-dimethylaminophenyl methacrylate, p-N,N-diethylaminophenyl methacrylate, p-N,N-dipropylaminophenyl methacrylate, p-N,N-dibutylaminophenyl methacrylate, p-N,N-dimethylaminobenzyl acrylate, p-N,N-diethylaminobenzyl acrylate, p-N,N-dipropylaminobenzyl acrylate, p-N,N-dibutylaminobenzyl acrylate, p-N,N-dimethylaminobenzyl methacrylate, p-N,N-diethylaminobenzyl methacrylate, p-N,N-dipropylaminobenzyl methacrylate, p-N,N-dibutylaminobenzyl methacrylate, N,N-dimethylaminoethyl vinyl ether, N,N-diethylaminoethyl vinyl ether, N,N-dibutylaminoethyl vinyl ether, N,N-dimethylaminopropyl vinyl ether, N,N-diethylaminopropyl vinyl ether, N,N-dimethylaminoethyl isopropenyl ether, N,N-diethylaminoethyl isopropenyl ether, N,N-dimethylaminopropyl isopropenyl ether, and N,N-diethylaminopropyl isopropenyl ether. These compounds may be used either individually or in combination of two or more thereof.

Of these, from the standpoint of easy availability, dimethylaminoethyl methacrylate, diethylaminoethyl methacrylate, dimethylaminoethyl acrylate, or diethylaminoethyl acrylate is preferable.

There are various factors for making the disperse phase form a film at room temperature to exhibit satisfactory fixing properties. It is necessary that the disperse phase should have a Tg of not higher than room temperature, i.e., not higher than 20° C. In order to prevent the disperse phase from becoming too soft, the Tg is desirably not lower than about −30° C., though depending on the composition of the microcapsule toner or the condition of use. Tg of the disperse phase can be adjusted by controlling the monomer ratio of the copolymer to be incorporated into the disperse phase or by using a plasticizer. Preferable Tg of the disperse phase is from −10 to 10° C., and more preferably from −5 to 5° C.

Where Tg adjustment is effected by means of a copolymer of radical polymerizable monomers, the Tg of a copolymer, taking a two-component copolymer for instance, is given by formula:

$$1/Tg=w1/Tg1+w_2/Tg_2$$

wherein Tg, $Tg_1$, and $Tg_2$ are glass transition temperatures of the copolymer, a homopolymer of one of the monomers, and a homopolymer of the other monomer, respectively; and $w_1$ and $w_2$ are weight proportions of one of the monomers and the other monomer, respectively.

Examples of radical polymerizable monomers affording a high Tg include t-butyl acrylate, methyl methacrylate, ethyl methacrylate, n-propyl methacrylate, iso-propyl methacrylate, n-butyl methacrylate, iso-butyl methacrylate, t-butyl methacrylate, styrene, o-, m- or p-methylstyrene, 2,4-dimethylstyrene, 2,5-dimethylstyrene, 3,4-dimethylstyrene, butylstyrene, methoxystyrene, phenylstyrene, and phenoxystyrene.

Examples of radical polymerizable monomers affording a low Tg include n-butyl acrylate, n-hexyl acrylate, 2-ethylhexyl acrylate, n-octyl acrylate, lauryl acrylate, tridecyl acrylate, stearyl acrylate, n-octyl methacrylate, lauryl methacrylate, tridecyl methacrylate, and polydimethylsiloxane.

Where Tg adjustment of the disperse phase is effected by means of a plasticizer, a Tg can be dropped to a desired level by proper selection of the kind and the amount of a plasticizer. aExamples of usable plasticizers include phosphoric esters (e.g., tributyl phosphate and triphenyl phosphate), phthalic esters (e.g., dibutyl phthalate and di-n-octyl phthalate), aliphatic monobasic acid esters (e.g., butyl oleate and glycerol mono-oleate ester), aliphatic dibasic acid esters (e.g., di-n-hexyl adipate and dibutyl sebacate), dihydric alcohol esters (e.g., diethylene glycol dibenzoate and triethylene glycol di-2-ethylbutyrate), oxy acid esters (e.g., butylphthalylbutyl glycolate and acetyl tributyl citrate), chlorinated paraffin, chlorinated biphenyl, 2-nitrobiphenyl, dinonylnaphthalene, o- or p-toluenesulfonethylamide, camphor, and methyl abietate.

These plasticizers can be used in an amount of from 2 to 50%, and preferably 2 to 20%, by the weight to the disperse phase.

The disperse phase can be used in an amount of from 5 to 80%, preferably from 20 to 70%, and more preferably from 35 to 65%, by the weight to the fixable component.

The continuous phase of the micro phase seperation structure may be formed by a high-boiling solvent (the term "high-boiling solvent" as used herein means a solvent whose boiling point is higher than that of water) singly or contain a polymer as dissolved in the high-boiling solvent. In case of a liquid polymer at room temperature, the continuous phase may be formed by the polymer singly. In case of containing a polymer as dissolved in the high-boiling solvent, a resin having a weight molecular weight of from 15,000 to 300,000, and preferably from 20,000 to 100,000 can be used as the polymer, and the resin can be added in amount of from 5 to 90%, and preferably from 10 to 70%, by the weight to the continuous phase. The liquid polymer at room temperature includes an acrylate and methacrylate ester containing a long chain alkyl group having not less than 15 carbon atoms, which has a weight average molecular weight of from 2,000 to 15,000.

The continuous phase of the micro phase separation structure can be comprised of a high-boiling solvent. Suitable high-boiling solvents include phthalic esters (e.g., diethyl phthalate and dibutyl phthalate), aliphatic dibasic acid esters (e.g., diethyl malonate, dimethyl succinate, and dioctyl adipate), phosphoric esters (e.g., tricresyl phosphate and trixylyl phosphate), citric esters (o-acetyltriethyl citrate and tributyl citrate), benzoic esters (e.g., butyl benzoate and hexyl benzoate), higher fatty acid esters (e.g., hexadecyl myristate and dodecyl stearate), alkylnaphthalenes (e.g., methylnaphthalene, monoisopropylnaphthalene, and diisopropylnaphthalene), alkyl diphenyl ethers (e.g., o-, m- or p-methyl diphenyl ether), higher fatty acid amides (e.g., N,N-dimethyllaurylamide), aromatic sulfonamides (e.g., N-butylbenzenesulfonamide), trimellitic esters (e.g., trioctyl trimellitate), diarylalkanes (e.g., a diarylmethane, e.g., xylylphenylmethane; and a diarylethane, e.g., 1-phenyl-1-triethane, 1-xylyl-1-phenylethane, and 1-ethylphenyl-1-phenylethane), and aliphatic saturated hydrocarbons.

The continuous phase may contain a polymer as dissolved in the above-mentioned high-boiling solvent. Examples of suitable polymers to be dissolved in the high-boiling solvent are the same as those enumerated above as examples of the resins to be incorporated into the disperse phase. Preferred of them are styrene polymers and (meth)acrylic ester polymers or copolymers. It should be noted here that the polymer present in the continuous phase must be different from that used in the disperse phase in order to form a micro phase separation structure.

The high-boiling solvent forming the continuous phase should not completely dissolve the resin contained in the disperse phase. To this effect, aliphatic saturated hydrocarbon solvents are preferably used. In using the microcapsule toner of the present invention in electrophotography using an organic photoreceptor, the solvent must not denature the organic photoreceptor. From this viewpoint, aliphatic saturated hydrocarbon solvents are also preferred. Specific examples of the aliphatic saturated hydrocarbon solvents are Isopar G, Isopar H, Isopar L, Isopar M, Isopar V, EXXSOL D40, EXXSOL D 80, and EXXSOL D 110 (all produced by Exxon Chemical Co.).

The continuous phase of the micro phase separation structure may also be comprised of a crystalline polymer having a low Tg or a low melting point, i.e., a polymer or oligomer which is liquid at room temperature, using no high-boiling solvent. Examples of the liquid polymers or oligomers include homo- or copolymers of n-butyl acrylate, n-hexyl acrylate, 2-ethylhexyl acrylate, n-octyl acrylate, lauryl acrylate, tridecyl acrylate, stearyl acrylate, n-octyl methacrylate, lauryl methacrylate, tridecyl methacrylate, and dimethylsiloxane.

The fixable component of the present invention is characterized by containing at least one copolymers selected from block copolymers and graft copolymers as a compatibilizer for a disperse phase and a continuous phase.

The block copolymer comprises at least one monomer component compatible with the components constituting the disperse phase and at least one monomer component compatible with the components constituting the continuous phase. The block copolymer can be prepared by known processes, for example, the processes described in *Polymer Alloy "KISO TO OYO"*, edited by KOBUNSHI GAKKAI, published by TOKYO KAGAKU DOJIN (1985). According to the above publication, polymerization processes are classified into radical polymerization, mechanochemical reaction, anion polymerization, cation polymerization, coordination polymerization, and successive growth reaction, and processes recommended for preparing a block copolymer with a controlled molecular weight and a controlled copolymerization ratio which is particularly advantageous for forming a micro phase separation structure are anion living polymerization, cation living polymerization, linkage of an anion living polymer and a cation living polymer, synthesis utilizing a terminal functional group, cation polymerization, active seed conversion, coordination ion polymerization, etc.

Commercially available products of such block copolymers are Blemmer CP produced by Nippon Oils & Fats Co., Ltd.; Bondfast and Bondine produced by Sumitomo Chemical Co., Ltd.; Rexpearl and N Polymer produced by Nippon Petrochemicals Co., Ltd.; Admer produced by Mitsui Petrochemical Industries, Ltd.; Taftic produced by Asahi Chemical Industry Co., Ltd.; Seputon produced by Kuraray Co., Ltd.; and Cariflex TR and Craton G produced by Shell Chemical Co., Ltd.

The graft copolymers can also be prepared by known processes. For example, *Polymer Alloy "KISO TO OYO"* supra mentions chain transfer reaction, oxidative graft polymerization, ion graft polymerization, radiation graft polymerization, and graft polymerization using a macromonomer. Commercially available graft copolymers include Modiper A produced by Nippon Oils & Fats Co., Ltd.; VMX produced by Mitsubishi Petro-chemical Co., Ltd.; and Rezeda produced by Toa Gosei Chemical Industry Co., Ltd.

Graft polymerization using a macromonomer is particularly advantageous in that a graft copolymer can be prepared by simple and easy operation as in general radical polymerization. That is, a monomer or monomers of a polymer or a copolymer providing a main chain is (are) easily copolymerized in the presence of a macromonomer by bulk polymerization, solution polymerization or suspension polymerization while controlling the molecular weight and other physical properties with ease. Various types of macromonomers are commercially sold by Toa Gosei Chemical Industry Co., Ltd. Macromonomers comprising silicone segments are commercially sold by Shin-Etsu Chemical Industry Co., Ltd. and Chisso Corporation.

Polymerization initiators which can be used in the block or graft copolymerization include azo compounds, e.g., 2,2'-azobisisobutyronitrile, 2,2'-azobis(2-methylbutyronitrile), and 2,2'-azobis(2,4-dimethylvaleronitrile), and peroxides, e.g., cumene hydroperoxide, benzoyl peroxide, and lauryl peroxide.

The block copolymer and/or the graft copolymer can be used in an amount of from 0.1 to 50%, preferably from 0.5 to 30%, and more preferably from 1 to 20%, by the weight to the core.

The block copolymer and/or the graft copolymer have a weight average molecular weight of from 10,000 to 500,000, preferably from 15,000 to 300,000, and more preferably from 20,000 to 100,000.

The colorants which can be used in the present invention and which may be incorporated either inside or outside the microcapsules include inorganic pigments, such as carbon black, red oxide, Prussian blue, and titanium oxide; azo pigments, such as Fast Yellow, Disazo Yellow, Pyrazolone Red, Chelate Red, Brilliant Carmine, and Para Brown; phthalocyanine pigments, such as copper phthalocyanine and metal-free phthalocyanine; and condensed polycyclic pigments, such as Flavanthrone Yellow, Dibromoanthrone Orange, Perylene Red, Quinacridone Red, and Dioxazine Violet. Disperse dyes and oil-soluble dyes may also be employed.

In the case of magnetic one-component toners, a magnetic powder can also be used as a colorant. Usable magnetic powders include magnetite, ferrite, single metals, e.g., cobalt, iron or nickel, or alloys thereof. The magnetic powder may be surface-treated with a silane coupling agent, a titanium coupling agent or other organic or inorganic substances.

When the colorant is a magnetic powder, the colorant can be used in an amount of from 10 to 75%, and preferably from 35 to 65%, by the weight to the total toner. When the colorant is a non-magnetic pigment, the colorant can be used in an amount of from 0.1 to 20%, preferably from 0.5 to 10%, by the weight to the total toner. The colorants which can be used in the present invention may be incorporated inside the core material, inside the shell or the core/shell interface. It is preferably to control the colorants to be inside the shell, or the,core/shell interface by adding the colorants in the reaction of interfacial polymerization.

For encapsulation, known techniques, such as interfacial polymerization, phase separation, and in-situ polymerization, may be utilized, but taking ease in shell formation, completeness of covering, and mechanical strength of the shell into consideration, encapsulation by interfacial polymerization is excellent. Encapsulation by interfacial polymerization can be carried out according to various known manipulations disclosed, e.g., in JP-A-57-179860, JP-A-58-66948, JP-A-59-148066, and JP-A-59-162562. For example, from the standpoint of ease of polymerization, properties of the shell, etc., the shell preferably comprises polyurethane, polyurea or a copolymer thereof prepared from a polyisocyanate and a polyol or a polyamine.

Suitable polyisocyanates include 2,4-tolylene diisocyanate, 2,6-tolylene diisocyanate, diphenylmethane diisocyanate, polymeric diphenylmethane diisocyanate, hydrogenated diphenylmethane diisocyanate, 1,5-naphthalene diisocyanate, 3,3'-dimethyldiphenyl-4,4'-diisocyanate, hexamethylene diisocyanate, isophorone diisocyanate, m-phenylene diisocyanate, p-phenylene diisocyanate, trans-cyclohexane-1,4-diisocyanate, diphenyl ether diisocyanate, xylylene diisocyanate, hydrogenated xylylene diisocyanate, 2,6-diisocyanatocaproic acid, tetramethyl-m-xylene diisocyanate, tetramethyl-p-xylene diisocyanate, trimethylhexamethylene diisocyanate, triphenylmethane triisocyanate, tris(isocyanatophenyl) thiophosphate, 2,6-diisocyanato isocyanatoethyl caproate, 1,6,11-undecane triisocyanate, 1,8-diisocyanato-4-isocyanatomethyloctane, 1,3,6-hexamethylene triisocyanate, and bicycloheptane triisocyanate.

Modified polyisocyanate compounds derived from the above-mentioned polyisocyanates, such as a methane-modified polyisocyanate prepared from a polyisocyanate and a polyol monomer, a trimethylolpropane adduct, a urethane prepolymer prepared from a polyisocyanate and a polyether polyol or a polyester polyol, a urethidione-modified polyisocyanate, an isocyanurate-modified polyisocyanate, a carbodiimide-modified polyisocyanate, a urethaneimine-modified polyisocyanate, an allophanate modified polyisocyanate, and a burette-modified polyisocyanate, may also be used.

Suitable polyols include ethylene glycol, propylene glycol, glycerin, trimethylolpropane, pentaerythritol, bisphenol A, a polyether polyol, and a polyester polyol. Water may also be used.

Suitable polyamines include ethylenediamine, hexamethylenediamine, diethylenetriamine, triethylenetetramine, tetraethylenepentamine, 2-methylpentamethylenediamine, phenylenediamine, xylylenediamine, diaminodiphenylmethane, diethyltoluenediamine, t-butyltoluenediamine, piperazine, 2,5-dimethylpiperazine, and 1,4-bis(3-aminopropyl) piperazine.

Polyether polyamines obtained by converting the terminal of a polyether polyol into an amino group may also be used. The polyether polyamines are commercially available under trade names of Jeffamine D-230, D-400, D-2000 or T-403, all produced by Sanseki Texaco Chemical Co., Ltd.

Formation of a capsule shell and encapsulation of a fixable component can preferably be carried out as follows.

An oily mixture comprising a fixable component, other core components, and a shell-forming component (e.g., a polyisocyanate), etc. and a colorant are suspended in a medium, e.g., water, by stirring together with a dispersant. A polyol or a polyamine is added to the dispersing medium, and an outer shell is formed by, for example, interfacial polymerization. At the same time, the resin to be contained in the disperse phase and the continuous phase-forming liquid, i.e., a high-boiling solvent and, if necessary, a polymer dissolved in the high-boiling solvent or a liquid polymer or oligomer are vigorously stirred to form a micro phase separation structure.

The micro phase separation structure of the fixable component may have previously been formed prior to mixing with other components, such as core components, a polyisocyanate, a colorant, etc.

The microcapsule toner of the present invention has a particle size of from 1 to 20 μm, and preferably from 3 to 15 μm.

The shell of the present invention preferably has a thickness of from 0.5 to 2 μm when the colorants are inside the shell, and of from 0.2 to 0.8 μm when the colorants are not inside the shell.

The dispersant which can be used in encapsulation includes water-soluble high polymers, such as gelatin, gum arabic, sodium alginate, casein, methyl cellulose, carboxymethyl cellulose, hydroxyethyl cellulose, hydroxypropylmethyl cellulose, polyacrylic acid, a vinylbenzenesulfonic acid copolymer, starch, and polyvinyl alcohol; and inorganic fine particles, such as colloidal silica, colloidal alumina, calcium tertiary phosphate, aluminum hydroxide, ferric hydroxide, calcium carbonate, barium carbonate, barium sulfate, and bentonite.

The dispersing medium or oily mixture may contain a surface active agent. Suitable surface active agents include anionic surface active agents, e.g., higher fatty acid sodium salts, sodium alkylsulfates, alkylbenzenesulfonates, alkylnaphthalenesulfonates, sodium oleamide sulfonate, sodium dialkylsulfosuccinates, dialkyl phosphates, monoalkyl phosphates, polyoxyethylene sulfuric acid ester salts, and Turkey red oil; cationic surface active agents, e.g., halogenated trimethylaminoethyl fatty acid amides and alkylpyridinium sulfates; nonionic surface active agents, e.g., polyoxyethylene alkyl ethers, polyoxyethylene fatty acid esters, polyoxyethylene alkylphenol ethers, polyhydric alcohol fatty acid esters, and sorbitan fatty acid esters; and amphoteric surface active agents, e.g., N-alkyltrimethylaminoacetic acids and lecithin.

The dispersing medium which can be used is usually water. Besides water, ethylene glycol, glycerin, butyl alcohol, octyl alcohol, or a mixture thereof with water may also be used as a dispersing medium.

Where the mixture of the fixable component, a polyisocyanate, a colorant, etc. has a high viscosity, a microcapsule toner may be prepared by previously adding the mixture to a low-boiling solvent or a polar solvent, suspending the mixture in a dispersing medium, and driving the low-boiling solvent or polar solvent out of the system simultaneously with or after formation of the outer shell. The low-boiling solvent or polar solvent may be removed before capsule formation.

The term "low-boiling solvent" as used herein means a solvent whose boiling point is lower than that of water, such as methylene chloride, chloroform, carbon tetrachloride, ethylene chloride, carbon disulfide, acetone, methyl ethyl ketone, methyl acetate, ethyl acetate, methyl alcohol, ethyl alcohol, ethyl ether, tetrahydrofuran, n-pentane, n-hexane, benzene, and petroleum ether. Examples of the polar solvent are dioxane, cyclohexanone, methyl isobutyl ketone, and dimethylformamide. These solvents may be used either individually or as a mixture thereof.

For the purpose of preventing offset at the time of fixing, the core may contain a wax or silicone oil. Examples of waxes which can be used include animal waxes, e.g., bees wax, whale wax, Chinese wax, and lanolin; vegetable waxes, candelilla wax, carnauba wax, Japan wax, rice wax, and sugar cane wax; mineral waxes, e.g., montan wax, ozokerite, ceresin, and lignite wax; petroleum waxes, e.g., paraffin wax and microcrystalline wax; modified waxes, e.g., montan wax derivatives, paraffin wax derivatives, and microcrystalline wax derivatives; hydrogenated waxes, e.g., castor wax and opal wax; polyolefin waxes, e.g., low-molecular polyethylene, low-molecular polypropylene and derivatives thereof; synthetic waxes, e.g., Akura wax and distearyl ketone; saturated fatty acid amides wax, e.g., capronamide, caprylamide, pelargonic amide, capric amide, laurylamide, tridecanoic amide, myristylamide, stearamide, behenic amide, and ethylene-bisstearamide; and unsaturated fatty acid amides wax, e.g., caproleic amide, myristoleic amide, oleamide, elaidic amide, linoleic amide, erucamide, ricinoleic amide, and linolenic amide. These waxes may be used either individually or as a mixture of two or more thereof.

If desired, the microcapsule toner of the present invention may be rendered negatively or positively chargeable by triboelectricity or electrically conductive by any known technique. For example, the toner may be rendered electrically conductive by addition of a conducting agent, such as carbon black, graphite, tin oxide, antimony-doped tin oxide, etc.

For the purpose of improving chargeability, powder fluidity, lubricating properties, and the like, the microcapsule toner of the invention may further contain fine particles of an inorganic substance (e.g., metals, metal oxides, metal salts, silica, or ceramics), a resin or a fatty acid metal salt.

The microcapsule toner according to the present invention is applicable to not only pressure fixing but fixing by both heat and pressure. It is also applicable to an image recording system in which transfer and fixing of a toner are conducted simultaneously by using an image recording apparatus having a press member which presses an image carrier member via recording paper or a press member having therein a heating means. It is also effective when applied to a heat fixing system.

The disperse phase of the fixable component of the microcapsule toner undergoes phase inversion or agglomeration simply by mechanical force without requiring penetration of the continuous phase into paper. Accordingly, the microcapsule toner of the present invention can be used for recording on not only paper but a secondary original or paper for an overhead projector.

In the present invention, the disperse phase component and the continuous phase component must be essentially incompatible with each other. Should they be compatible with each other to form a homogeneous mixture, pressure deformability or fluidity before fixing and hardness after fixing cannot be obtained consistently. Mere mixing of incompatible components only provides a dispersion that will turn into a mere two phase system with passage of time. In other words, a stable micro phase structure cannot be formed without using, as a compatibilizer, a copolymer comprising at least two components each separately exhibits compatibility to the disperse phase component and the continuous phase component. Such a stable micro phase separation structure can first satisfies both the deformability or fluidity before fixing and the hardness after fixing in good consistency.

Considering the phase inversion of the disperse phase on fixing, phase inversion of the fixable component takes place by an increase of the proportion of the disperse phase remaining on a medium (e.g., paper) due to penetration of the continuous phase into the medium, or by the mechanical force of fixing, or by the mechanical force resulting from sliding of the fixable component running out of the capsule shell among toner particles or between toner particles and the medium. While it is desirable that toner film formation is accomplished through the phase inversion of the disperse phase, even if phase inversion does not occur, the fixable component substantially hardens after fixing due to the above-mentioned increase of the proportion of the disperse phase on a medium or agglomeration of the fixable component on a medium. That is, since the hardening of the fixable component owes to film formation through phase inversion or agglomeration, firm fixing of the fixable component can sufficiently be achieved with no need to use a volatile liquid, much less to increase volatility of an oily liquid.

The present invention will now be illustrated in greater detail with reference to Examples, but it should be understood that the present invention is not construed as being limited thereto. All the percents are by weight unless otherwise indicated.

EXAMPLE 1

1) Preparation of Styrene-Butyl Acrylate Copolymer:

| | |
|---|---|
| Styrene monomer | 100 g |
| Butyl acrylate monomer | 100 g |
| Toluene | 200 g |
| Azobisisobutyronitrile | 1 g |

A mixture of the above components was put in a 1 l four-necked separable flask equipped with a stirrer, a reflux condenser, and a thermometer, and nitrogen gas was blown thereinto at room temperature for 30 minutes while stirring. The temperature of the mixture was elevated up to 90° C. at a rate of 1° C./min by heating on an oil bath in a nitrogen atmosphere with stirring, and the mixture was maintained at that temperature for 5 hours. The reaction mixture was distilled under reduced pressure, and the residue was re-precipitated twice first in toluene and then in methanol and dried at 100° C. for 24 hours to obtain a copolymer having a weight average molecular weight of 90,000 and a Tg of 0° C. The resulting copolymer was designated SB-5050.

Tg measurement was made with a differential scanning calorimeter according to an input compensation method as specified in JIS K-7121 (hereinafter the same).

2) Preparation of Lauryl Methacrylate Polymer:

| | |
|---|---|
| Lauryl methacrylate monomer | 200 g |
| Toluene | 200 g |
| Azobisisobutyronitrile | 1 g |

A mixture of the above components was put in a 1 l four-necked flask equipped with a stirrer, a reflux condenser and a thermometer, and nitrogen gas was blown thereinto at room temperature for 30 minutes under stirring. The temperature of the mixture was elevated up to 90° C. at a rate of 1° C./min in a nitrogen atmosphere by heating on an oil bath with stirring, and the mixture was maintained at that temperature for 5 hours. The reaction mixture was distilled under reduced pressure, and the residue was re-precipitated twice first in toluene and then in methanol and dried at 100° C. for 24 hours to obtain a copolymer having a weight average molecular weight of 50,000. The resulting copolymer was designated LMA-100.

3) Preparation of Graft Copolymer:

Two grams of a styrene-butyl acrylate (50:50 by weight) copolymerized macromonomer having a methacryloyl group at the terminal thereof (a product of Toa Gosei Chemical Industry Co., Ltd.; number average molecular weight: 6,000; weight average molecular weight: 15,000), 8 g of lauryl methacrylate, and 0.05 g of 2,2'-azobis(2,4-dimethylvaleronitrile) were put in a 30 ml test tube and thoroughly mixed to form a solution. The test tube and the contents were heated on an oil bath at a rate of 1° C./min up to 90° C., at which the solution was kept for 5 hours. The resulting copolymer was re-precipitated twice first in toluene and then in methanol and dried at 100° C. for 24 hours. The copolymer was designated LMA-g-SB.

4) Preparation of Capsule Particles:

The following components were dispersed in a 300 ml ball mill for 1 day. The resulting dispersion was designated magnetic powder dispersion A.

| | |
|---|---|
| LMA-100 | 2.3 g |
| Magnetic powder (EPT-1000, produced by Toda Kogyo Co., Ltd.) | 50 g |
| Aliphatic saturated hydrocarbon solvent (Isopar V, produced by Exon Chemical Co.) | 17.8 g |
| Ethyl acetate | 18.6 g |

Separately, the following components were thoroughly stirred in a beaker to prepare a milky white dispersion. The resulting dispersion was designated dispersion B.

| | |
|---|---|
| SB-5050 | 19 g |
| LMA-100 | 3.1 g |
| LMA-g-SB | 7.1 g |
| Ethyl acetate | 13.75 g |

To dispersion B were added 81 g of magnetic powder dispersion A and 21 g of a trimethylolpropane adduct of xylylene diisocyanate (Takenate D11ON, produced by Takeda Chemical Industries, Ltd.), and the mixture was thoroughly mixed. The resulting dispersion was designated dispersion C.

In 200 g of ion-exchanged water was dissolved 8 g of hydroxypropylmethyl cellulose (Metholose 65SH50, produced by Shin-Etsu Chemical Industry Co., Ltd.), and the solution was cooled to 5° C. The solution was stirred in an emulsifier (Auto Homomixer, manufactured by Tokushu Kika Kogyo Co., Ltd.), and dispersion C was slowly poured therein to emulsify. There was thus prepared an O/W emulsion comprising oil droplets having an average particle size of about 12 $\mu$m.

The resulting emulsion was stirred in a stirrer equipped with a propeller blade (Three-One Motor, manufactured by Shinto Kagaku Co., Ltd.) at 400 rpm. Ten minutes later, 100 g of a 5% diethylenetriamine aqueous solution was added dropwise to the emulsion. After the addition, the mixture was heated to 60° C. to conduct encapsulation for 3 hours while driving ethyl acetate out of the system. The reaction mixture was poured into 2 l of ion-exchanged water, and the mixture was thoroughly stirred, followed by allowing to stand still. After capsule particles sedimented, the supernatant liquor was removed. The above washing operation was repeated 7 more times to obtain capsule particles according to the present invention.

5) Preparation of Toner:

The resulting capsule particles were suspended in ion-exchanged water to have a solids content of 40%. To 125 g of the capsule suspension (containing 50 g of capsule particles) was added 125 g of ion-exchanged water, followed by stirring in the same stirrer as used above at 200 rpm. To the suspension were added 5 g of 1N nitric acid and 4 g of a 10% cerium sulfate aqueous solution, and 0.5 g of ethylene glycol dimethacrylate, followed by allowing the mixture to react at 15° C. for 3 hours. The reaction mixture was poured into 1 l of ion-exchanged water, thoroughly stirred, and allowed to stand still. After the capsule particles sedimented, the supernatant liquor was discarded. The above washing operation was further repeated twice to obtain capsule particles having ethylene glycol dimethacrylate grafted to the surface of the shell.

The resulting capsule particles were again suspended in ion-exchanged water and stirred in the same stirrer as used above at 200 rpm. To the suspension were successively added 0.4 g of potassium persulfate, 1 g of trifluoroethyl methacrylate, and 0.16 g of sodium hydrogensulfite, and the mixture was allowed to react at 25° C. for 3 hours. The reaction mixture was poured into 2 l of ion-exchanged water, thoroughly stirred, and allowed to stand. After the capsule particles sedimented, the supernatant liquor was removed. The above washing operation was further repeated 4 times to obtain a microcapsule toner in which trifluoroethyl methacrylate was graft-polymerized to the surface of the capsule shell.

The resulting capsule toner was put in a stainless steel-made vat and dried at 60° C. for 10 hours in a drier manufactured by Yamato Kagaku Co., Ltd. Thirty grams of the toner were thoroughly mixed with 0.3 g of hydrophobic silica (R 972, produced by Nippon Aerosil Co., Ltd.).

6) Observation of Micro Phase Separation Structure:

| | |
|---|---|
| SB-5050 | 19 g |
| LMA-100 | 4.8 g |
| LMA-g-SB | 7.1 g |
| Isopar v | 13.2 g |
| Ethyl acetate | 27.5 g |

The above components were thoroughly stirred in a beaker to prepare a milky white dispersion. The dispersion was heated at 70° C. for 3 days under evacuation to evaporate ethyl acetate. The residue assumed a milky white color and was the same as the fixable component contained in the core of the microcapsule toner prepared above. Observation under an optical microscope revealed a micro phase separation structure in which particles of not greater than 1.5 $\mu$m were stably dispersed. The same microscopic observation after preservation for 2 months showed no change of the micro phase separation structure.

On the other hand, when dispersion C was placed on a magnet to cause the magnetic powder to sediment, the supernatant liquor was a milky white dispersion. When observed under an optical microscope, the supernatant liquor had a micro phase separation structure having a dispersed particle size of not more than 1.5 $\mu$m. This indicate that the phase separation structure is not affected by mixing of a magnetic powder and a polyisocyanate.

Further, the cross section of the toner particle was observed under a scanning electron microscope (SEM) utilizing a cryosystem. As a result, a micro phase separation structure in which the styrene-butyl acrylate copolymer formed a disperse phase was confirmed. The same observation after 2 months revealed no change in the structure.

7) Evaluation of Fixing Properties:

The microcapsule toner was set in a copying machine, Model 2700 manufactured by Fuji Xerox Co., Ltd., in which the developing part had been remodeled for a capsule toner and from which the fixing means had been removed. A toner image taken from an original picture was transferred to paper and fixed by means of a pressure fixing machine comprising two stainless steel rolls at a linear contact pressure of 20 kg/cm.

When the toner image immediately after being fixed was rubbed with a blank sheet of paper, there was observed neither peeling of the toner nor staining of the background and the paper.

Further, the fixed toner image was scrubbed off the transfer paper, and the degree of peeling of the toner was observed and rated according to a 7-rating system, in which the best quality was rated "1", and the worst quality "7". Fixing properties rated "4" or higher levels are acceptable for practical use. In this example, the fixing level after scrubbing was "3".

When paper was superposed on the toner image, and letters were written thereon with a ballpoint pen, no offset was observed.

After 2 months from the toner preparation, the fixing properties were evaluated in the same manner as above. No reduction of the fixing properties was observed at all.

COMPARATIVE EXAMPLE 1

1) Preparation of Toner:

A capsule toner was prepared in the same manner as in Example 1, except changing the composition of dispersion B as follows.

| | |
|---|---|
| SB-5050 | 20.4 g |
| LMA-100 | 8.8 g |
| Ethyl acetate | 13.75 g |

The mixture of the above composition, dispersion A, and the diisocyanate adduct was thoroughly stirred throughout the subsequent steps. If the stirring of the mixture is suspended, the mixture was immediately separated into two phases.

2) Observation of Micro Phase Separation Structure:

The same procedure as in Example 1-(6) was repeated, except for using no LMA-g-SB (graft copolymer) to prepare an evaporation residue corresponding to the fixable component used above. Within 10 minutes, the residue was separated into two phases.

The SEM observation of the cross section of the toner particle using a cryosystem proved separation of the fixable component into two phases.

3) Evaluation of Fixing Properties:

When the toner image immediately after being fixed was rubbed with a blank sheet of paper, there was observed considerable peeling the toner and staining of the background and the paper. Further, when the fixed toner image was scrubbed, the degree of peeling of the toner was rated "7".

When paper was superposed on the toner image, and letters were written thereon with a ballpoint pen, offset was observed.

EXAMPLE 2

1) Preparation of Graft Copolymer:

In a 1 l four-necked separable flask equipped with a stirrer, a reflux condenser, and a thermometer were put 170 g of a lauryl methacrylate macromonomer having a methacryloyl group at the terminal thereof (a product of Toa Gosei Chemical Industry Co., Ltd.; number average molecular weight: 8,000; weight average molecular weight: 18,000), 15 g of styrene monomer, 15 g of butyl acrylate monomer, 800 g of toluene, and 1 g of azobisisobutyronitrile, and nitrogen gas was blown thereinto at room temperature for 30 minutes while stirring. The mixture was heated on an oil bath at a rate of 1° C./min up to 90° C. in a nitrogen atmosphere while stirring, and the mixture was kept at that temperature for 5 hours. The resulting copolymer was re-precipitated twice first in toluene and then in methanol and dried at 100° C. for 24 hours. The copolymer was designated SB-g-LMA.

2) Preparation of Toner:

A capsule toner was prepared in the same manner as in Example 1, except for replacing LMA-g-SB with SB-g-LMA as a graft copolymer.

3) Observation of Micro Phase Structure:

| | |
|---|---|
| SB-5050 | 19 g |
| LMA-100 | 4.8 g |
| SB-g-LMA | 7.1 g |
| Isopar v | 13.2 g |
| Ethyl acetate | 27.5 g |

The above components were thoroughly stirred in a beaker to prepare a milky white dispersion. The dispersion was heated at 70° C. for 3 days under evacuation to evaporate ethyl acetate. The evaporation residue assumed a milky white color and had the same composition as the fixable component contained in the core of the microcapsule toner prepared above. Observation under an optical microscope revealed a micro phase separation structure in which particles of not greater than 1.5 μm were stably dispersed. The same microscopic observation after preservation for 2 months showed no change of the micro phase separation structure.

When the dispersion prepared in the same manner as for dispersion C of Example 1 was placed on a magnet to cause the magnetic powder to sediment, the supernatant liquor was a milky white dispersion. When observed under an optical microscope, the supernatant liquor had a micro phase separation structure having a dispersed particle size of not more than 1.5 μm. This indicate that the phase separation structure is not affected by mixing of a magnetic powder and a polyisocyanate.

Further, the SEM observation of the cross section of the toner particle utilizing a cryosystem lent confirmation to the micro phase separation structure in which the styrene-butyl acrylate copolymer formed a disperse phase. The same observation after 2 months revealed no change in the structure.

4) Evaluation of Fixing Properties:

When the toner image immediately after being fixed was rubbed with a blank sheet of paper, there was observed neither peeling of the toner nor staining of the background and the paper. Further, the degree of peeling of the toner when scrubbed was rated "4". When paper was superposed on the toner image, and letters were written thereon with a ballpoint pen, no offset was observed. After 2 months from the preparation, the same evaluation of the fixing properties was made. No change in fixing level was observed at all.

EXAMPLES 3 TO 6 AND COMPARATIVE EXAMPLE 2

1) Preparation of Styrene-Butyl Acrylate Copolymer:

A styrene-butyl acrylate copolymer was prepared in the same manner as in Example 1, except for changing the styrene to butyl acrylate monomer ratio as shown in Table 1 below . The weight average molecular wight and Tg of each of the resulting copolymers are shown in the Table together with those of SB-5050 used in Examples 1 and 2.

TABLE 1

| | | Composition | | Weight Average Molecular | Tg. |
|---|---|---|---|---|---|
| Example No. | Sample | Monomer | Ratio | Weight | (° C.) |
| Examples 1 and 2 | SB-5050 | styrene/butyl acrylate | 10/10 | 90,000 | 0 |
| Example 3 | SB-6040 | styrene/butyl acrylate | 12/8 | 80,000 | 18 |
| Example 4 | SB-4060 | styrene/butyl acrylate | 8/12 | 90,000 | −11 |
| Example 5 | SB-3565 | styrene/butyl acrylate | 7/13 | 70,000 | −19 |
| Example 6 | SB-2575 | styrene/butyl acrylate | 5/15 | 80,000 | −29 |
| Compar. Example 2 | SB-6535 | styrene/butyl acrylate | 13/7 | 70,000 | 28 |

2) Preparation of Toner:

A capsule toner was prepared in the same manner as in Example 1, except for using the following composition as dispersion B.

| | |
|---|---|
| Styrene-butyl acrylate copolymer of Table 1 | 19.5 g |
| LMA-100 | 7.3 g |
| SB-g-LMA | 2.4 g |
| Ethyl acetate | 13.75 g |

3) Observation of Micro Phase Separation Structure:

The SEM observation of the cross section of each toner using a cryosystem revealed a micro phase separation structure in which the styrene-butyl acrylate copolymer formed a disperse phase.

4) Evaluation of Fixing Properties:

The resulting toner was evaluated in the same manner as in Example 1. The results obtained are shown in Table 2 below together with the results of Examples 1 and 2.

TABLE 2

| Example No. | Copolymer | Peeling of Toner on Rubbing with Paper | Contamination on Rubbing with Paper | Offset on Writing with Ball-Point Pen | Peeling of Toner on Scrubbing |
|---|---|---|---|---|---|
| Example 1 | SB-5050 | good | good | good | 4 |
| Example 2 | SB-5050 | good | good | good | 4 |
| Example 3 | SB-6040 | good | good | good | 4 |
| Example 4 | SB-4060 | good | good | good | 3 |
| Example 5 | SB-3565 | good | good | good | 3 |
| Example 6 | SB-2575 | good | good | good | 4 |
| Comparative Example 2 | SB-6535 | poor | slightly poor | slightly poor | 5 |

EXAMPLE 7

1) Preparation of Styrene-Butyl Acrylate-Diethylaminoethyl Methacrylate Copolymer:

| | |
|---|---|
| Styrene monomer | 80 g |
| Butyl acrylate monomer | 120 g |
| Diethylaminoethyl methacrylate | 20 g |
| Toluene | 200 g |
| Azobisisobutyronitrile | 1 g |

A mixture of the above components was put in a 1 l four-necked separable flask equipped with a stirrer, a reflux condenser, and a thermometer, and nitrogen gas was blown therein at room temperature for 30 minutes while stirring. The temperature of the mixture was elevated up to 90° C. at a rate of 1° C./min in a nitrogen atmosphere while heating on an oil bath with stirring, and the mixture was maintained at that temperature for 5 hours. The reaction mixture was distilled under reduced pressure, and the residue was re-precipitated twice first in toluene and then in methanol and dried at 100° C. for 24 hours to obtain a copolymer having a weight average molecular weight of 70,000 and a Tg of −7° C. The resulting copolymer was designated SBA-406010.

2 Preparation of Toner:

A capsule toner was prepared in the same manner as in Example 1, except for replacing SB-5050 with SBA-406010.

3) Observation of Micro Phase Separation Structure:

The SEM observation of the cross section of the toner particle utilizing a cryosystem lent revealed a micro phase separation structure.

4) Evaluation of Fixing Properties:

The fixing properties were evaluated in the same manner as in Example 1. Rubbing of the fixed toner image with paper caused neither peeling of the toner nor staining of the background and the paper. Further, the degree of peeling of the toner on scrubbing was rated "2". When paper was superposed on the toner image, and letters were written thereon with a ballpoint pen, no offset was observed. After 2 months from the preparation, the same evaluation of the fixing properties was made. No change in fixing level was observed at all.

EXAMPLE 8

1) Preparation of Toner:

A capsule toner was prepared in the same manner as in Example 1, except for using the following composition as dispersion A.

| | |
|---|---|
| LMA-100 | 2.3 g |
| Magnetic powder (EPT-1000w) | 50 g |
| Ethyl acetate | 36.4 g |

2) Observation of Micro Phase Separation Structure:

The SEM observation of the cross section of the resulting toner particle utilizing a cryosystem revealed a micro phase separation structure in which the styrene-butyl acrylate copolymer formed a disperse phase.

3) Evaluation of Fixing Properties:

The fixing properties of the toner were evaluated in the same manner as in Example 1. Rubbing of the fixed toner image with paper caused neither peeling of the toner nor staining of the background and the paper. The degree of peeling of the toner on scrubbing was rated "4". When paper was superposed on the toner image, and letters were written thereon with a ballpoint pen, no offset was observed. After 2 months from the preparation, no change in fixing level was observed.

EXAMPLE 9

1) Preparation of Styrene Polymer:

| | |
|---|---|
| Styrene monomer | 200 g |
| Toluene | 200 g |
| Azobisisobutyronitrile | 1 g |

A mixture of the above components was put in a 1 l four-necked separable flask equipped with a stirrer, a reflux condenser, and a thermometer, and nitrogen gas was blown therein at room temperature for 30 minutes while stirring. The temperature of the mixture was elevated up to 90° C. at a rate of 1° C./min in a nitrogen atmosphere while heating on an oil bath with stirring, and the mixture was maintained at that temperature for 5 hours. The reaction mixture was distilled under reduced pressure, and the residue was re-precipitated twice first in toluene and then in methanol and dried at 100° C. for 24 hours to obtain a copolymer having a weight average molecular weight of 100,000 and a Tg of 97° C. The resulting copolymer was designated S-100.

2) Preparation of Graft Copolymer:

Two grams of a styrene macromonomer having a methacryloyl group at the terminal thereof (a product of Toa Gosei Chemical Industry Co., Ltd.; number average molecular weight: 6,000), 8 g of lauryl methacrylate, and 0.05 g of 2,2'-azobis(2,4-dimethylvaleronitrile) were put in a 30 ml test tube and thoroughly mixed to form a solution. The test tube and the contents were heated on an oil bath at a rate of 1° C./min up to 90° C., at which the solution was kept for 5 hours. The resulting copolymer was re-precipitated twice first in toluene and then in methanol and dried at 100° C. for 24 hours. The copolymer was designated LMA-g-S.

3) Preparation of Toner:

A capsule toner was prepared in the same manner as in Example 1, except for using the following composition as dispersion B.

| | |
|---|---|
| S-100 | 11 g |
| LMA-100 | 3.1 g |
| LMA-g-S | 7.1 g |
| Dibutyl phthalate | 8 g |
| Ethyl acetate | 13.75 g |

The above prepared uniform mixture containing S-100 and dibutyl phthalate had a Tg of −1° C.

4) Observation of Micro Phase Separation Structure:

The SEM observation of the cross section of the resulting toner particle utilizing a cryosystem lent confirmation to the micro phase separation structure. 5) Evaluation of Fixing Properties:

The fixing properties of the toner were evaluated in the same manner as in Example 1. Rubbing of the fixed toner image with paper caused neither peeling of the toner nor staining of the background and the paper. Further, the degree of peeling of the toner on scrubbing was rated "4". When paper was superposed on the toner image, and letters were written thereon with a ballpoint pen, no offset was observed. After 2 months from the preparation, no change in fixing level was observed at all.

EXAMPLE 10

1) Preparation of Methyl Methacrylate-Butyl Acrylate Copolymer:

| | |
|---|---|
| Methyl methacrylate monomer | 100 g |
| Butyl acrylate monomer | 100 g |
| Toluene | 200 g |
| Azobisisobutyronitrile | 1 g |

A mixture of the above components was put in a 1 l four-necked separable flask equipped with a stirrer, a reflux condenser, and a thermometer, and nitrogen gas was blown thereinto at room temperature for 30 minutes while stirring. The temperature of the mixture was elevated up to 90° C. at a rate of 1° C./min in a nitrogen atmosphere by heating on an oil bath with stirring, and the mixture was maintained at that temperature for 5 hours. The reaction mixture was distilled under reduced pressure, and the residue was re-precipitated twice first in toluene and then in methanol and dried at 100° C. for 24 hours to obtain a copolymer having a weight average molecular weight of 70,000 and a Tg of 0C. The resulting copolymer was designated MB-5050.

2) Preparation of Graft Copolymer:

In a 1 l four-necked separable flask equipped with a stirrer, a reflux condenser, and a thermometer were put 140 g of a lauryl methacrylate macromonomer having a methacryloyl group at the terminal thereof (a product of Toa Gosei Chemical Industry Co., Ltd.; number average molecular weight: 8,000; weight average molecular weight: 18,000), 30 g of methyl methacrylate, 30 g of butyl acrylate, 800 g of toluene, and 1 g of azobisisobutyronitrile, and nitrogen gas was blown thereinto at room temperature for 30 minutes while stirring. The mixture was heated on an oil bath at a rate of 1° C./min up to 90° C. in a nitrogen atmosphere while stirring, and the mixture was kept at that temperature for 5 hours. The resulting copolymer was re-precipitated twice first in toluene and then in methanol and dried at 100° C. for 24 hours. The copolymer was designated MB-g-LMA.

Preparation of Toner:

A capsule toner was prepared in the same manner as in Example 1, except for replacing SB-5050 with MB-5050 and replacing LMA-g-SB with MB-g-LMA.

3) Observation of Micro Phase Separation Structure:

The SEM observation of the cross section of the resulting toner particle utilizing a cryosystem lent confirmation to the micro phase separation structure in which the methyl methacrylate-acrylate copolymer formed a disperse phase.

4) Evaluation of Fixing Properties:

The fixing properties of the toner were evaluated in the same manner as in Example 1. Rubbing of the fixed toner image with paper caused neither peeling of the toner nor staining of the background and the paper. Further, the degree of peeling of the toner on scrubbing was rated "3". When paper was superposed on the toner image, and letters were written thereon with a ballpoint pen, no offset was observed. After 2 months from the preparation, no change in fixing level was observed at all.

EXAMPLE 11

1) Preparation of Toner:

| | |
|---|---|
| S-100 | 22 g |
| Hydrogenated styrene-isoprene-styrene triblock copolymer (Seputon 2003, produced by Kuraray Co., Ltd.) | 8 g |
| Isopar V | 27 g |
| Dioctyl phthalate | 10 g |
| Magnetic powder (EPT-1000) | 57 g |
| Ethyl acetate | 42 g |

The above components were mixed and dispersed in a 300 ml ball mill for one day. To 109 g of the resulting dispersion was added 21 g of a trimethylolpropane adduct of xylylene diisocyanate (Takenate D110N). The mixture was thoroughly mixed and further processed in the same manner as in Example 1 to prepare a capsule toner.

2) Observation of Micro Phase Separation Structure:

The SEM observation of the cross section of the resulting toner particle utilizing a cryosystem lent confirmation to the micro phase separation structure in which the styrene polymer formed a disperse phase.

3) Evaluation of Fixing Properties:

The fixing properties of the toner were evaluated in the same manner as in Example 1. Rubbing of the fixed toner image with paper caused neither peeling of the toner nor staining of the background and the paper. Further, the degree of peeling of the toner on scrubbing was rated "4". When paper was superposed on the toner image, and letters were written thereon with a ballpoint pen, no offset was observed. After 2 months from the preparation, no change in fixing level was observed. According to the present invention, the fixable component of the microcapsule toner has a micro phase separation structure comprising a disperse phase containing a resin and having a Tg of not higher than 20° C. and a liquid continuous phase. On pressure application, the toner is instantaneously fixed to provide a fixed toner image which does not fall off or is not destroyed by outer force. Sufficient fixing performance is exhibited without necessarily involving volatilization of a solvent component.

Further, the block or graft copolymer comprising a component compatible with a disperse phase and a component compatible with a continuous phase is used as a compatibilizer. Therefore, the fixable component forms a stable micro phase separation structure which satisfies both fluidity before fixing and hardness after fixing and retains fixability during long-term preservation.

While the invention has been described in detail and with reference to specific examples thereof, it will be apparent to one skilled in the art that various changes and modifications can be made therein without departing from the spirit and scope thereof.

What is claimed is:

1. A microcapsule toner comprising a core containing a fixable component, and provided thereon a shell, wherein the fixable component has a micro phase separation structure composed of a liquid continuous phase and a disperse phase containing a resin and having a glass transition temperature of not higher than 20° C., and said fixable component contains a block and/or graft copolymer comprising two or more monomer components, at least one of the monomer components being compatible with said disperse phase with the other monomer component or components being compatible with said continuous phase.

2. A microcapsule toner as claimed in claim 1, wherein said resin contained in the disperse phase is a copolymer obtained by copolymerization of two or more radical polymerizable monomers.

3. A microcapsule toner as claimed in claim 1, wherein said resin contained in the disperse phase is a copolymer obtained by copolymerization of a polymerizable tertiary amino group-containing compound.

4. A microcapsule toner as claimed in claim 1, wherein said disperse phase contains a plasticizer.

5. A microcapsule toner as claimed in claim 1, wherein said continuous phase comprises an aliphatic saturated hydrocarbon solvent.

6. A microcapsule toner as claimed in claim 1, wherein said continuous phase comprises a liquid polymer or oligomer.

7. A microcapsule toner as claimed in claim 1, wherein said graft copolymer is a polymer obtained by graft polymerization in the presence of a macromonomer.

* * * * *